US008235673B2

(12) United States Patent
Tanaka et al.

(10) Patent No.: US 8,235,673 B2
(45) Date of Patent: Aug. 7, 2012

(54) CONTROL METHOD OF INVERTER COMPRESSOR AND INVERTER COMPRESSOR

(75) Inventors: Hideharu Tanaka, Shizuoka (JP); Shingo Goto, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 574 days.

(21) Appl. No.: 12/365,910

(22) Filed: Feb. 5, 2009

(65) Prior Publication Data

US 2009/0232687 A1 Sep. 17, 2009

(30) Foreign Application Priority Data

Mar. 11, 2008 (JP) ..... 2008-061422

(51) Int. Cl.
*F04B 49/00* (2006.01)

(52) U.S. Cl. ..... 417/12

(58) Field of Classification Search ..... 417/12, 417/44.1, 45, 44.11
See application file for complete search history.

(56) References Cited

U.S. PATENT DOCUMENTS 3,777,240 A * 12/1973 Neill ..... 318/471
4,706,152 A * 11/1987 DeFilippis et al. ..... 361/32
5,138,844 A * 8/1992 Clanin et al. ..... 62/89
6,749,404 B2 * 6/2004 Gennami et al. ..... 417/212
2004/0011051 A1 * 1/2004 Ryan et al. ..... 60/773
2004/0184930 A1 * 9/2004 Millet et al. ..... 417/286
2010/0232983 A1 * 9/2010 Maeda et al. ..... 417/53
2011/0157752 A1 * 6/2011 Sakanobe et al. ..... 361/18

FOREIGN PATENT DOCUMENTS

JP 07-19613 1/1995
JP 08-210277 8/1996
JP 8-247075 9/1996
JP 08-247075 9/1996
JP 2000-74458 3/2000
JP 3255213 11/2001

OTHER PUBLICATIONS

Computer translation of Takebayashi.*
Office Action issued in Chinese Patent Application No. 200910005156.8 on Dec. 19, 2011.

* cited by examiner

*Primary Examiner* — Peter MacChiarolo
(74) *Attorney, Agent, or Firm* — Antonelli, Terry, Stout & Kraus, LLP.

(57) ABSTRACT

The present invention provides a control method and a control apparatus of an inverter compressor in which when a trip occurs immediately after the inverter is started, retry can be performed in a short period of time with restart being performed in accordance with the detected conditions after the retry waiting times which are different from each other elapse. There are provided two or more kinds of retry waiting times, and the retry waiting time immediately after starting is made shorter than the others.

12 Claims, 4 Drawing Sheets

CONTROL METHOD OF INVERTER COMPRESSOR AND INVERTER COMPRESSOR

BACKGROUND OF THE INVENTION

The present invention relates to retry control (restart control) when an inverter trip of an inverter compressor occurs.

As an example of an inverter compressor, there is an inverter oil-cooled screw compressor. The oil-cooled screw compressor supplies a lubricant to a screw unit of the compressor. However, when the compressor stops, some of the lubricant remains inside a main body of the compressor. Therefore, when the compressor is started at a low temperature lower than, for example, the lower limit of a predetermined temperature, the viscosity of the lubricant which remains inside the main body of the compressor is increased so as to generate an excessive torque caused by compression of the lubricant immediately after the starting, thereby generating overcurrent to cause a trip in the inverter in some cases. Further, even in an oil-free compressor, the viscosity of a lubricant which remains in a bearing unit is increased when a main body of the compressor is started, which possibly causes generation of an excessive torque and an overcurrent trip of the inverter at the time of starting. Especially, a high-efficiency synchronous motor as a driving motor shows this tendency due to a small starting torque. As a related art of such retry control when the inverter trip occurs, is represented by Japanese Patent No. 3255213, titled "CONTROL METHOD FOR PACKAGE TYPE SCREW COMPRESSOR AND CONTROL DEVICE".

SUMMARY OF THE INVENTION

In the above-described related art, when the inverter trip occurs, retry control (restart control) is performed after an internal pressure (a pressure on the discharge side of the main body of the compressor) of a separator 6 is lowered to a pressure (a pressure where the staring torque becomes sufficiently small) where the main body of the compressor can be restarted.

Further, when the compressor stops due to occurrence of the trip in the oil-cooled screw compressor, the air mixed with the lubricant in the separator rises to an upper surface of the lubricant inside the separator while expanding along with lowering of the internal pressure of the separator to generate a bubbling phenomenon. When the bubbling phenomenon is excessively generated, there is a trouble such as lacking of the lubricant at the time of starting due to consumption of the lubricant caused by the bubbling phenomenon. Thus, it takes a long time, for example, about 10 to 30 seconds, to lower the internal pressure of the separator to almost the atmosphere pressure. Therefore, as a retry waiting time, the same time period is needed. In an example of the above-describe related art, the waiting time is set to 20 seconds.

In the meantime, in the case where the trip occurs immediately after the inverter is started, the pressure on the discharge side of the main body of the compressor hardly rises from the pressure where the compressor waits before starting, and it is not necessary to lower the pressure on the discharge side of the compressor. Thus, the compressor can be immediately restarted. However, since the retry waiting time is uniformly set to 10 to 30 seconds from the viewpoint of suppressing the bubbling inside the separator as described above, it is necessary to wait for a long time to retry even when the inverter trip immediately after the starting, and the pressure necessary in the compressor can not be promptly secured.

The present invention provides a control method of an inverter compressor and an inverter compressor in which when a trip occurs immediately after the inverter is started, retry can be performed in a short period of time.

In order to solve the above described problem, the present invention provides a control method of an inverter compressor in which when an inverter trip occurs, the compressor is restarted after a retry waiting time which is preliminarily set so as to lower a pressure on a discharge side of a main body of the compressor to a pressure where the main body of the compressor can be restarted elapses, wherein conditions when the inverter trip occurs are detected and restarting is performed in the retry waiting times which are different from each other in accordance with the detected conditions.

Further, as the above-described conditions, an operation elapsed time from the time the inverter is started to the time the trip occurs is detected, and the retry waiting time is determined in accordance with the detected operation elapsed time.

Further, as the above-described conditions, the rotation speed of a motor immediately before the inverter trip occurs is detected, and the retry waiting time is determined in accordance with the detected rotation speed of the motor.

Further, as the above-described conditions, the pressure on the discharge side of the main body of the compressor when the inverter trip occurs is detected, and the retry waiting time is determined in accordance with the detected pressure.

Further, at least two kinds of retry waiting times t1 and t2, which are different from each other are set, and t2<t1 is set so that t2 denotes the retry waiting time when the trip occurs immediately after the inverter is started and t1 denotes the retry waiting time when the trip occurs in a normal operation of the inverter.

Further, the present invention provides an inverter compressor, which is restarted after a retry waiting time which is preliminarily set so as to lower a pressure on a discharge side of a main body of the compressor to a pressure, where the main body of the compressor can be restarted elapses when an inverter trip occurs, wherein there is provided a control unit that detects conditions when the inverter trip occurs and issues a restart instruction in the retry waiting times which are different from each other in accordance with the detected conditions.

Further, the control unit includes a detection unit that detects an operation elapsed time from the time the inverter is started to the time the trip occurs, with the retry waiting time is determined in accordance with the detected operation elapsed time.

Further, the control unit includes a detection unit that detects the rotation speed of a motor immediately before the inverter trip occurs, with the retry waiting time is determined in accordance with the detected rotation speed of the motor.

Further, the control unit includes a detection unit that detects the pressure on the discharge side of the main body of the compressor when the inverter trip occurs, with the retry waiting time is determined in accordance with the detected pressure.

Further, the control unit includes memories that store at least two kinds of retry waiting times t1 and t2, which are different from each other, and t2<t1 is set where t2 denotes the retry waiting time when the trip occurs immediately after the inverter is started and t1 denotes the retry waiting time when the trip occurs in a normal operation of the inverter.

According to the present invention, a necessary retry waiting time is secured when an inverter trip occurs in a normal operation and the retry waiting time can be shortened when the inverter trip occurs immediately after the starting, so that restarting can be performed in a short time and a necessary pressure can be promptly secured.

DETAILED DESCRIPTION OF PREFERRED EMBODIMENTS

Hereinafter, a first embodiment of the present invention will be described.

First Embodiment

Figure 1:
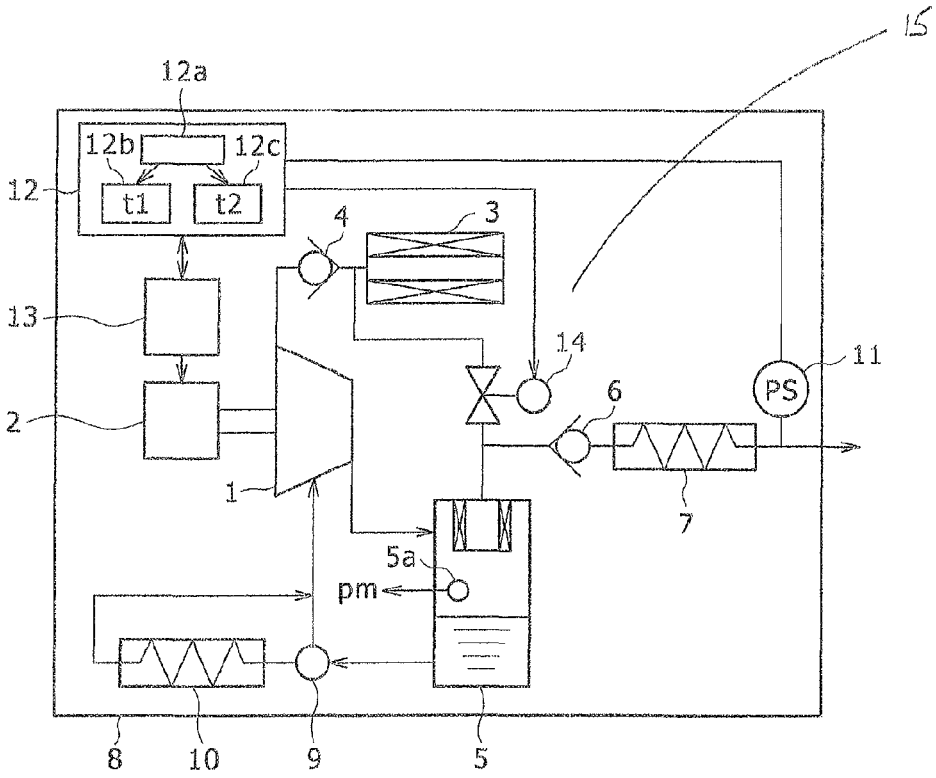
FIG. 1 is a retry control flow diagram according to a first embodiment of the present invention.

FIG. 1 is a diagram for showing a flow of an oil-cooled screw compressor. The reference numeral 1 denotes a main body of the oil-cooled screw compressor which is rotationally driven by, for example, a synchronous motor 2. The main body 1 of the compressor which is rotationally driven sucks the air in the atmosphere through a filter 3 and a suction check valve 4 to compress the air into a predetermined pressure. Since the compressed air in the main body 1 of the compressor contains a lubricant, the compressed air is substantially separated from the lubricant by an oil separator 5, and then is discharged to an external load of a package 8 through a check valve 6 and a compressed-air heat exchanger 7. On the other hand, the lubricant which is separated from the compressed air by the oil separator 5 is fed to the main body 1 of the compressor again after the temperature of the lubricant is automatically adjusted through a lubricant temperature adjusting valve 9 and a lubricant heat exchanger 10.

A control unit 12 issues an operation instruction to an inverter 13 so as to operate the motor 2, and controls the rotation speed of the motor 2 in accordance with the pressure which is detected by a pressure detection unit 11 to be discharged to the external load. The reference numeral 14 denotes a discharge valve which is opened or closed by the control unit 12 and through which the pressure on the discharge side 15 of the compressor is discharged. The discharge valve 14 is opened at the same time when an inverter trip occurs, and is closed at the same time when an inverter retry waiting time elapses.

Figure 2:
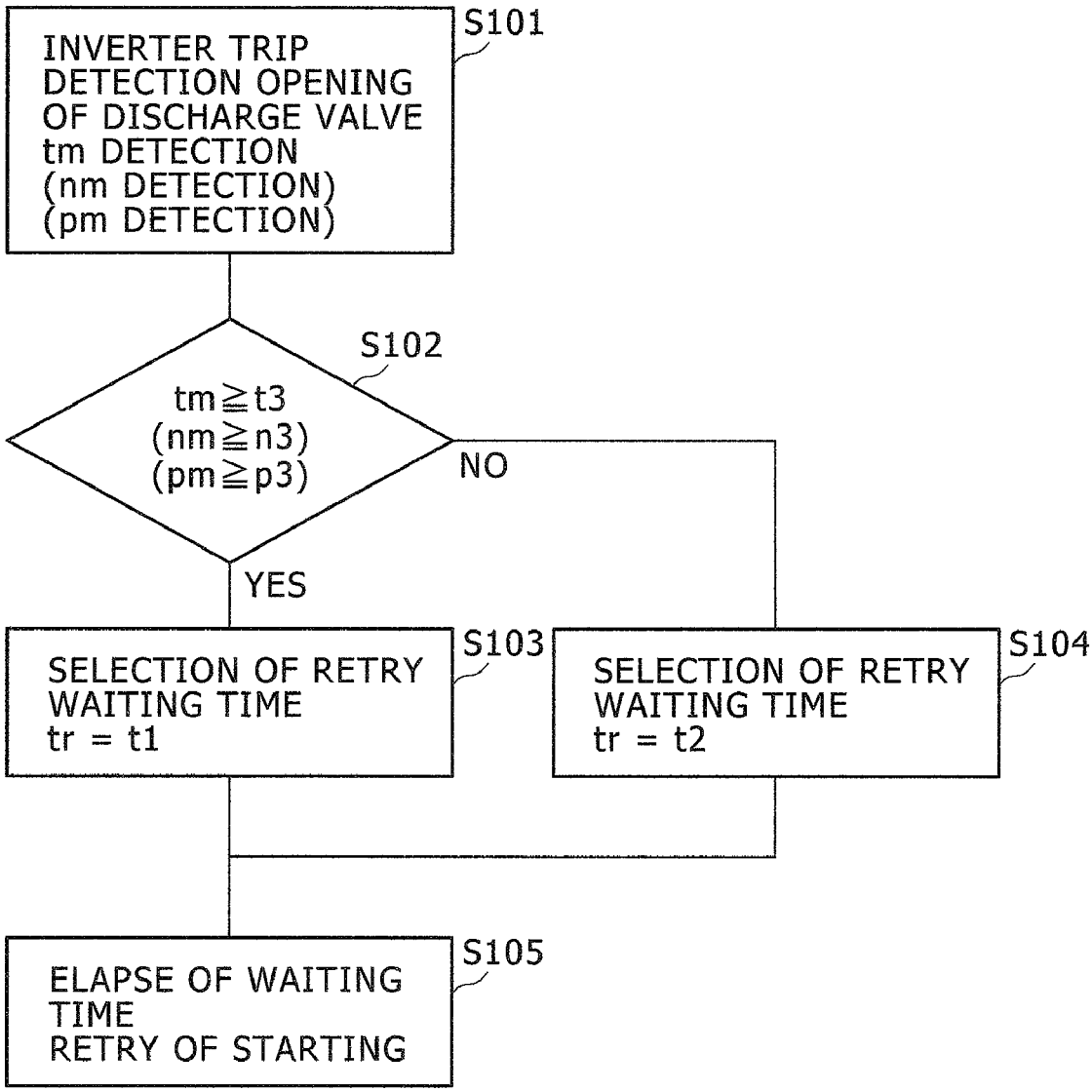
FIG. 2 is an operation flowchart according to the first embodiment of the present invention.

The control unit 12 includes a detection unit 12*a* which detects an operation elapsed time from the time the inverter 13 is started to the time the trip occurs, and memories 12*b* and 12*c* which stores t1 and t2 of the inverter retry waiting times, respectively. The both waiting times satisfy the relation of t1>t2. In addition, an operation logic shown in FIG. 2 is incorporated into the control unit 12. In FIG. 2, tm denotes the operation elapsed time from the time the inverter 13 is started to the time the trip occurs, t3 denotes a preliminarily-set standard elapsed time which corresponds to an elapsed time for example, about 1 second) from the time the inverter 13 is started to the time immediately after the inverter 13 is started, and tr denotes a retry waiting time.

Next, there will be described a retry control (restart control) operation after the inverter causes the trip. When the inverter being operated causes the trip, the detection unit 12*a* of the control unit 12 detects the operation elapsed time tm until the occurrence of the trip in S101 of FIG. 2. The time tm is detected as an elapsed time from the time the inverter is started to the time the trip occurs. At the same time, the discharge valve 14 is opened with an instruction of the control unit 12, and the pressure of the oil separator 5 begins to be lowered.

Next, the operation elapsed time tm and the standard elapsed time t3 are compared to each other in S102. In the case where the comparison result shows tm≧t3, the time t1 in the memory 12*b* is selected as the retry waiting time tr in S103 to wait during the time t1 in a state where the inverter is stopped after the occurrence of the trip. Then, after the time t1 elapses, the discharge valve 14 is closed in S105, and the inverter is retried. The time tm at this Lime exceeds the time (standard elapsed time) immediately after the inverter 13 is started, and the compressor is in a rated operation or is operated at a level where the compressor is started up towards the rated operation, so that the internal pressure on the discharge side is increased.

The time t1 is set to a time (for example, 10 to 30 seconds) during which the internal pressure of the oil separator 5 is discharged through the discharge valve 14 so that the internal pressure is lowered to a pressure where the inverter can restarted within the retry waiting time. Accordingly, if the inverter is retried after the time t1 elapses, the motor is reliably started and the compressor is driven.

In the case where tm<t3 is satisfied in S102, the time t2 in the memory 12*c* is selected as the retry waiting time tr in S104 to wait during the time t2 in a state where the inverter is stopped after the occurrence of the trip. Then, after the time t2 elapses, the inverter is retried in S105. Since the time tin at this time corresponds to the time immediately after the inverter 13 is started, the compressor is hardly operated, and the pressure (the pressure of the oil separator 5) on the discharge side of the main body of the compressor hardly rises from the pressure before the starting. The time t2 is set to a sufficiently short waiting time (for example, 5 seconds) because it is not necessary to lower the pressure of the oil separator 5. Accordingly, if the inverter is retried in a short time after the occurrence of the trip, it is possible to reliably start the motor.

Figure 3:
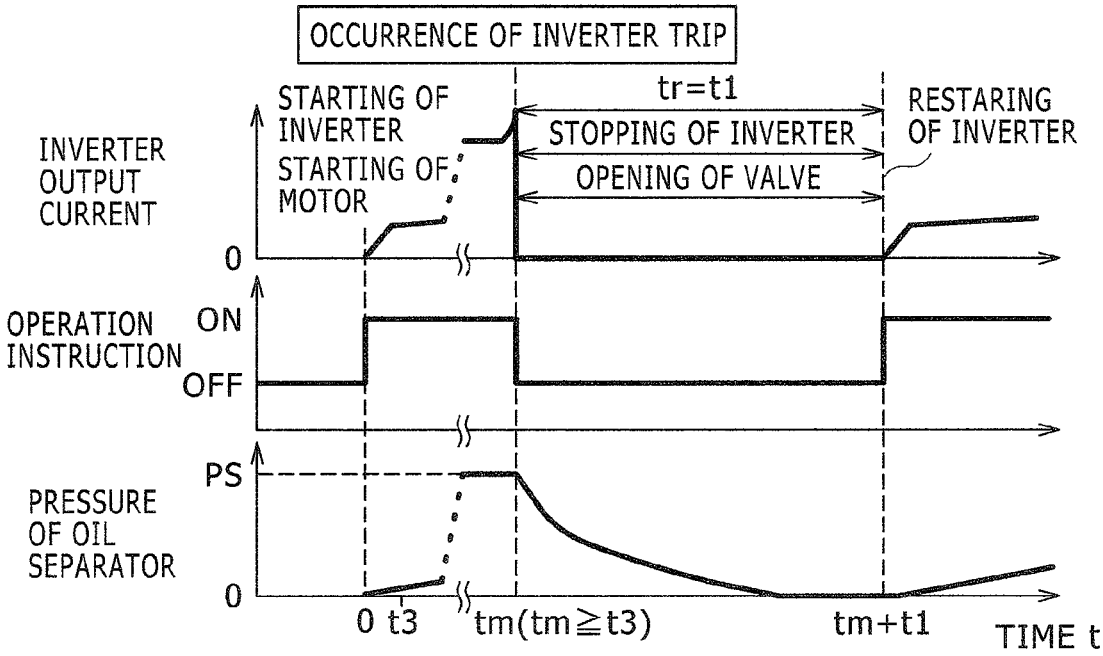
FIG. 3 is a time chart in the case where a trip occurs in a rated operation in the first embodiment of the present invention.

FIG. 3 is a time chart for showing a retry operation when an output current value is rapidly increased and the trip occurs in the state of tm≧t3 during the operation of the inverter 13 in a normal state. Since the operation elapsed time tm from the time the inverter is started (the time the operation instruction is generated) to the time the trip occurs exceeds the standard elapsed time t3, t1 is selected as the retry waiting time tr in accordance with S102 and S103 of the flowchart shown in FIG. 2. The pressure of the oil separator reaches a rated pressure PS at the time the trip occurs and a torque (load) at the time of restarting is too large due to the pressure PS in this state. Accordingly, if the inverter is retried, the motor can not be restarted.

After the trip occurs, the operation instruction from the inverter 13 is stopped, and the compressor waits during the time t1 in a stopped state, so that the discharge valve 14 is opened. The discharge valve 14 is opened during the time t1, the pressure of the oil separator is lowered to a pressure where the synchronous motor 2 can be restarted, and the pressure becomes almost 0 in FIG. 3. In this state, the synchronous motor 2 is stopped in an in-phase state caused by pull-in operation of a magnetic. After the time t1 elapses from the occurrence of the trip (after tm+t1 elapses from the starting), the discharge valve 14 is closed and a control instruction of retry is issued by the control unit 12, so that reoperation instruction is issued from the inverter 13. The synchronous motor is restarted without failure to drive the motor, and along with this, the pressure of the oil separator 5 rises again.

Figure 4:
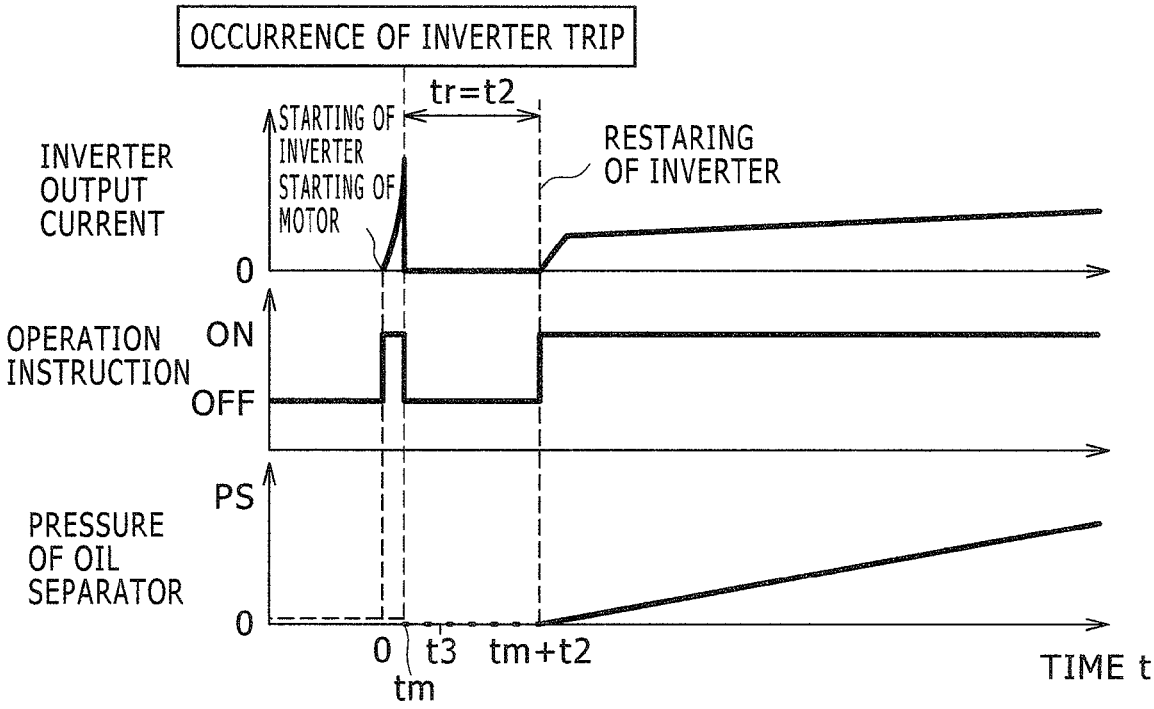
FIG. 4 is a time chart in the case where the trip occurs immediately after starting the compressor in the first embodiment of the present invention.

FIG. 4 is a time chart for showing a retry operation when an output current value is rapidly increased immediately after the inverter 13 is started and an overcurrent trip occurs in the state of tm<t3. Since the operation elapsed time tm from the time the inverter is started to the time the trip occurs does not exceed the standard elapsed time t3, t2 is selected as the retry waiting time in accordance with S102 and S103 of the flowchart shown in FIG. 2. Since the time tm at this time corresponds to the time immediately after the inverter 13 is started, the pressure of the oil separator 5 hardly rises from the pressure where the inverter waits before the starting. Accordingly, a torque at the time of restarting is extremely small. After the trip occurs, a control instruction of retry is issued by the control unit 12 after the short retry waiting time t2 selected elapses, and a reoperation instruction is issued from the inverter 13. The motor 2 is restarted without failure to drive the compressor, and along with this, the pressure of the oil separator 5 rises again.

In the embodiment, the retry waiting time tr is set to two kinds (t1 and t2), and t1 and t2 are associated with two kinds of large and small operation elapsed times tm before and after the standard elapsed time t3. However, the setting values of the retry waiting time may be increased to more than two kinds. In this case, the kind of the standard elapsed time t3 may be increased in accordance with the setting values of the retry waiting time. As described above, if the kinds of the setting values of the retry waiting time are increased, the retry control can be performed after the more-detailed retry waiting time elapses, so that the restarting can be performed in a shorter time after the trip which occurs at various timings.

Further, in the first embodiment, the retry waiting time tr is selected based on the operation elapsed time tm from the time the operation instruction is issued (the inverter is started) to the time the inverter trip occurs. However, since the operation elapsed time tm is in proportion to the rotation speed of the motor and the pressure in the oil separator 5 immediately before the occurrence of the trip, the retry waiting time tr may be selected based on the rotation speed (nm) and the pressure (pm) in the oil separator 5.

Second Embodiment

In the case where the rotation speed nm of the motor is based as a second embodiment, a standard rotation speed n3 corresponding to the standard elapsed time t3 in the first embodiment is set. When the trip occurs after the motor is started, the rotation speed nm of the motor as well as the trip of the inverter is detected in S101 of FIG. 2, and the detected rotation speed nm of the motor and the standard rotation speed n3 are compared to each other in the next S102. In the case where the comparison result shows nm≧n3, t1 is selected as the retry waiting time tr in S103. In the case where the comparison result shows nm<n3, t2 is selected as the retry waiting time tr in S103. The operation steps thereafter are the same as those in the first embodiment.

In the embodiment, the rotation speed nm of the motor is detected by the detection unit 12*a* while retrieving an instruction frequency issued from the inverter 13 to the motor 2 into the control unit 12. Accordingly, it is not necessary to include a rotation sensor or the like in the motor. Further, in the embodiment, the rotation speed nm of the motor is based. However, the torque of the compressor and the rotation speed of the motor which are necessary to determine whether or not to restart are preliminarily recognized, so that the retry control can be executed only by setting the standard rotation speed n3 without trying.

Third Embodiment

In the case where the pressure pm in the oil separator 5 is used for a base as a third embodiment, a standard pressure p3 corresponding to the standard elapsed time t3 in the first embodiment is set. When the trip occurs after the motor is started, the pressure pm in the oil separator 5 as well as the trip of the inverter is detected in S101 of FIG. 2, and the detected pressure pm and the standard pressure p3 are compared to each other in the next S102. In the case where the comparison result shows pm≧p3, t1 is selected as the retry waiting time tr in S103. In the case where the comparison result shows pm<p3, t2 is selected as the retry waiting time tr in S103. The operation steps thereafter are the same as those in the first embodiment.

In the embodiment, the pressure pm in the oil separator 5 is output from a pressure sensor 5*a* installed therein and is detected by the detection unit 12*a* while being retrieved into the control unit 12. Further, in the embodiment, the pressure pm in the oil separator 5 is used for a base. However, the pressure on the discharge side of the compressor which can be restarted is preliminarily recognized, so that the retry control can be executed only by setting the pressure as the standard pressure p3 without trying. Furthermore, if the retry control is performed after waiting until the pressure in the oil separator 5 is lowered to a pressure where the compressor can be restarted without using the retry waiting time, the retry control in accordance with the actual condition can be performed, so that it is possible to control without an unnecessary waiting time.

What is claimed is:

1. A control method of an inverter compressor that has a motor operated by an inverter, a main body of the compressor rotationally driven by the motor, an oil separator separating a lubricant from a compressed air of the main body of the compressor and a discharge valve discharging the pressure on the discharge side of the compressor, wherein when the inverter trip occurs, the discharge valve is opened to lower the pressure on the discharge side of the compressor, and in case that an operation elapsed time tm from the time the inverter is started to the time the trip occurs is shorter than a preliminarily-set standard elapsed time t3, the inverter compressor waits for a retry waiting time shorter than a retry waiting time in case that the operation elapsed time tm is longer than the standard elapsed time t3, then, when the retry waiting time elapses, the discharge valve is closed, and the inverter is restarted.

2. The control method of an inverter compressor according to claim 1, wherein the standard elapsed time corresponds to an elapsed time from the time the inverter is started to the time immediately after the inverter is started.

3. A control method of an inverter compressor that has a motor operated by an inverter, a main body of the compressor rotationally driven by the motor, an oil separator separating a lubricant from a compressed air of the main body of the compressor and a discharge valve discharging the pressure on the discharge side of the compressor, wherein when the inverter trip occurs, the discharge valve is opened to lower the pressure on the discharge side of the compressor, and in case that a rotation speed nm of the motor immediately before the inverter trip occurs is lower than a preliminarily-set standard rotation speed n3, the inverter compressor waits for a retry waiting time shorter than a retry waiting time in case that the rotation speed nm is higher than the standard rotation speed n3, then, when the retry waiting time elapses, the discharge valve is closed, and the inverter is restarted.

4. A control method of an inverter compressor that has a motor operated by an inverter, a main body of the compressor rotationally driven by the motor, an oil separator separating a lubricant from a compressed air of the main body of the compressor and a discharge valve discharging the pressure on the discharge side of the compressor, wherein when the inverter trip occurs, the discharge valve is opened to lower the pressure on the discharge side of the compressor, and in case that a pressure pm of the oil separator is lower than a preliminarily-set standard pressure p3, the inverter compressor waits for a retry waiting time shorter than a retry waiting time in case that the pressure pm is higher than the standard pressure p3, then, when the retry waiting time elapses, the discharge valve is closed, and the inverter is restarted.

5. An inverter compressor that has a motor operated by an inverter, a main body of the compressor rotationally driven by the motor, an oil separator separating a lubricant from a compressed air of the main body of the compressor, a discharge valve discharging the pressure on the discharge side of the compressor, and a control unit controlling the inverter and the discharge valve, wherein when the inverter trip occurs, the discharge valve is opened to lower the pressure on the discharge side of the compressor, and in case that an operation elapsed time tm from the time the inverter is started to the time the trip occurs is shorter than a preliminarily-set standard elapsed time t3, the inverter compressor waits for a retry waiting time shorter than a retry waiting time in case that the operation elapsed time tm is longer than the standard elapsed time t3, then, when the retry waiting time elapses, the discharge valve is closed, and the inverter is restarted.

6. The inverter compressor according to claim 5, wherein the control unit includes a detection unit that detects an operation elapsed time from the time the inverter is started to the time the trip occurs, and the retry waiting time is determined in accordance with the detected operation elapsed time.

7. The inverter compressor according to claim 5, wherein the standard elapsed time corresponds to an elapsed time from the time the inverter is started to the time immediately after the inverter is started.

8. The inverter compressor according to claim 7, wherein the rotation speed nm of the motor is detected by a detection unit while retrieving an instruction frequency issued from the inverter to the motor into the control unit.

9. The inverter compressor according to claim 5, wherein the control unit includes memories that store at least two kinds of different retry waiting times which are different from each other, and $t2<t1$ is set where t2 denotes the retry waiting time when the trip occurs immediately after the inverter is started and t1 denotes the retry waiting time when the trip occurs in a normal operation of the inverter.

10. An inverter compressor that has a motor operated by an inverter, a main body of the compressor rotationally driven by the motor, an oil separator separating a lubricant from a compressed air of the main body of the compressor, a discharge valve discharging the pressure on the discharge side of the compressor, and a control unit controlling the inverter and the discharge valve, wherein when the inverter trip occurs, the discharge valve is opened to lower the pressure on the discharge side of the compressor, and in case that a rotation speed nm of the motor immediately before the inverter trip occurs is lower than a preliminarily-set standard rotation speed n3, the inverter compressor waits for a retry waiting time shorter than a retry waiting time in case that the rotation speed nm is higher than the standard rotation speed n3, then, when the retry waiting time elapses, the discharge valve is closed, and the inverter is restarted.

11. The inverter compressor according to claim 10, wherein the pressure pm in the oil separator is output from a pressure sensor installed therein and is detected by a detection unit while being retrieved into the control unit 12.

12. An inverter compressor that has a motor operated by an inverter, a main body of the compressor rotationally driven by the motor, an oil separator separating a lubricant from a compressed air of the main body of the compressor, a discharge valve discharging the pressure on the discharge side of the compressor, and a control unit controlling the inverter and the discharge valve, wherein when the trip occurs, the discharge valve is opened to lower the pressure on the discharge side of the compressor, and in case that a pressure pm of the oil separator is lower than a preliminarily-set standard pressure p3, the inverter compressor waits for a retry waiting time shorter than a retry waiting time in case that the pressure pm is higher than the standard pressure p3, then, when the retry waiting time elapses, the discharge valve is closed, and the inverter is restarted.

* * * * *